US005163415A

United States Patent [19]

Moncrief et al.

[11] Patent Number: 5,163,415

[45] Date of Patent: Nov. 17, 1992

[54] PORTABLE COOKING UNIT

[76] Inventors: William A. Moncrief, 8091 Bingham, Detroit, Mich. 48228; Robert J. Masty, 20925 Bayside, St. Claire Shores, Mich. 48081

[21] Appl. No.: 803,538

[22] Filed: Dec. 9, 1991

[51] Int. Cl.[5] ..... F24C 5/00

[52] U.S. Cl. ..... 126/43; 126/50

[58] Field of Search ..... 126/43, 44, 45, 40, 126/50, 29, 30, 38; 431/344

[56] References Cited

U.S. PATENT DOCUMENTS

| | | | |
|---|---|---|---|
| 713,531 | 11/1902 | Taylor | 126/43 |
| 936,482 | 10/1909 | Seeley | 126/43 |
| 1,345,775 | 7/1920 | Hoffman | 126/45 |
| 2,356,788 | 8/1944 | Herron | 126/43 |
| 3,152,585 | 10/1964 | Harrison | 126/43 |
| 3,381,678 | 5/1968 | Fry | 126/43 |
| 4,134,385 | 1/1979 | Barter | 126/38 |
| 4,539,973 | 9/1985 | Hait | 126/43 |

FOREIGN PATENT DOCUMENTS

| | | | |
|---|---|---|---|
| 87527 | 4/1920 | Switzerland | 126/43 |

*Primary Examiner*—James C. Yeung

[57] ABSTRACT

A miniature outdoor cooking unit includes a base that can be positioned on a ground surface to support a can containing flammable fuel. A protective tube is removably supported on the base to provide wind protection for the flame that is generated by the fuel. Horizontal bars on the upper edge of the tube provide a support for a pot or pan that is to be heated by the cooking unit.

4 Claims, 1 Drawing Sheet

PORTABLE COOKING UNIT

BACKGROUND

1. Field of the Invention

This invention relates to portable outdoor cooking units, especially cooking units designed to utilize cans of flammable fuel as a heat source.

2. Prior Art Developments

Small portable cooking units are commonly used for heating or cooking food outdoors, e.g. at a campsite, in a wilderness environment, or on an outdoor patio In some cases the cooking unit utilizes canned heat as a heat source. Commonly, the canned heat comprises a small cylindrical container filled with an alcohol jelly; when the lid of the container is removed the alcohol can be ignited with a match or cigarette lighter to produce a hot flame in the space directly above the can. The flame can be extinguished by placing a flat plate over the mouth of the can.

Heat produced from the canned heat source is sufficient to effectively heat small pots or pans containing food or liquid, e.g. hot dogs, beans, coffee or cocoa. Canned heat is available under the tradename STERNO.

In order to effectively heat a cooking pot or pan with canned heat the pot or pan should be supported on a support surface located directly above the heat source. Additionally, the flame generated by the heat source should be protected from outdoor wind or rain. If there is any significant wind, the flame tends to flicker or dissipate, such that heat generated by the flame diffuses away from the pot bottom surface. Also, there is a danger that the flame will be extinguished.

The present invention is directed to a low cost cooking unit designed to use canned heat as a heat source. The cooking unit includes an upstanding protective housing for shielding the canned heat source against wind or rain disturbances. The pot-support surface comprises two or more horizontal bars that are longer than the diameter of the protective housing, whereby relatively large size pots can be supported in a stable position above the heat source.

Cooking units for a generally similar purpose are already known in the art. U.S. Pat. No. 4,539,973 to P. Hait shows a collapsible cooking unit for enclosing a small can containing flammable fuel. One disadvantage of the patented cooking unit is the fact that it comprises many component parts. The manufacturing cost of the unit would be relatively high.

U.S. Pat. No. 4,134,385 to O. Barter shows a cooking unit in the form of an annular frame adapted to seat on the upper edge of a can containing flammable fuel. Prongs extend downwardly from the frame along the outer side surfaces of the can, thereby holding the frame on the can. Arms extend upwardly from the frame to support a food container.

One disadvantage of the Barter cooking unit is that the flame is not protected (shielded) from wind forces. Another disadvantage is that only a small food container of a specific size can be supported on the cooking unit; it is not possible to use a conventional cooking pan with the Barter cooking unit. Additionally, the Barter cooking unit has a relatively small diameter, such that the food container is apt to tip over, especially if there is a wind disturbance or if the unit is placed on uneven terrain.

SUMMARY OF THE INVENTION

The present invention contemplates a portable cooking unit that includes a relatively wide low-profile base for supporting a can of flammable fuel thereon; the base includes a centering ring for holding the can in a central position on the base. A protective cylindrical tube is placed in an upright position on the base to encircle the can of fuel. Air holes in the tube side wall admit air to the combustion zone directly above the can; at the same time the tube protects the flame against extinguishment or undue flickering due to the disturbing effects of wind or rain. Two parallel horizontal bars are affixed to the upper edge of the protective tube to form a support surface for a cooking pot or frying pan. The bars extend horizontally beyond the tube circumference to provide an adequate stable support plane for a medium size pot or pan.

THE DRAWINGS

DESCRIPTION OF A PREFERRED EMBODIMENT OF THE INVENTION

Figure 1:
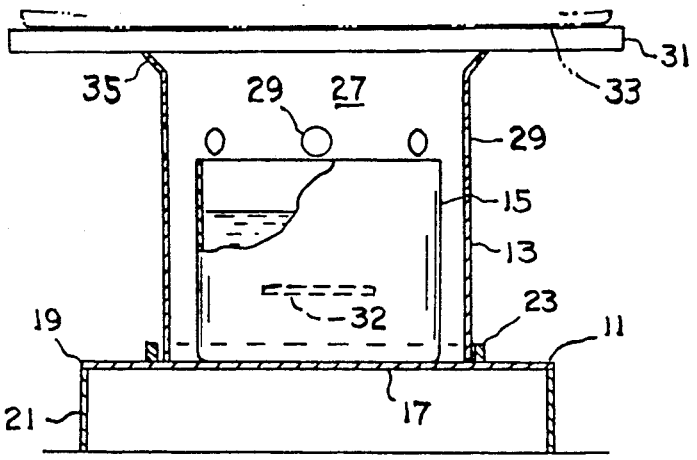
FIG. 1 is a sectional view taken through a cooking unit embodying the invention.
Figure 2:
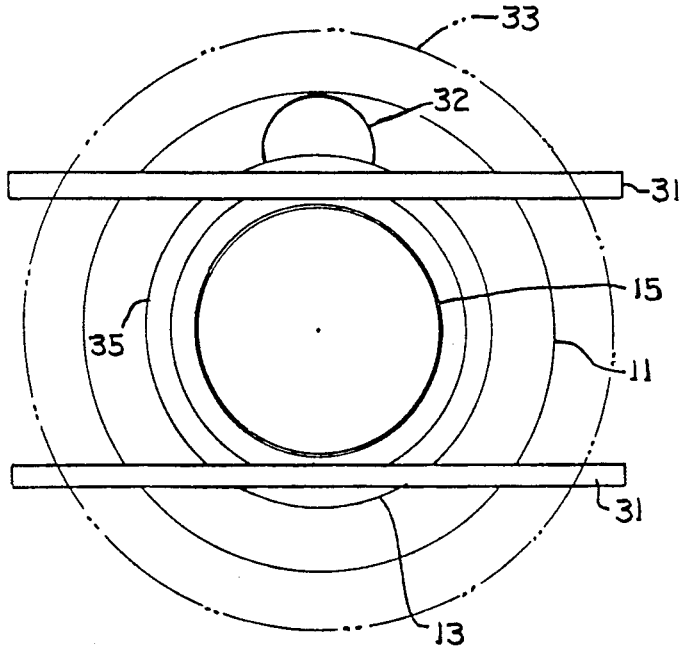
FIG. 2 is a top plan view of the FIG. 1 cooking unit.

FIGS. 1 and 2 show a cooking unit that includes a base 11 and an upstanding protective tube 13 for a can 15 containing a flammable fuel. Can 15 may in practice be a commercially available canned heat source sold under the tradename STERNO.

Base 11 comprises a flat metal plate 17 having a peripheral edge 19. A leg structure 21 extends downwardly from the peripheral edge of the plate for supporting the base on the ground surface, e.g. at a campsite. The base can be positioned on other surfaces, such as a table or counter.

Plate 17 can be square or round in the top plan view. The leg structure will be of corresponding shape, i.e. a square tube or a round tube. The leg structure is relatively short in the vertical direction, e.g. about one inch. Plate 17 will have a diameter or lateral dimension of about four or five inches, the primary criterion being that leg structure 21 has a wide-stance stable positionment on uneven ground surfaces, so as to maintain plate 17 in a reasonably level attitude.

A centering ring 23 is welded or otherwise affixed to the upper face of plate 17 for removable reception of a protective tube 13. Tube 13 is a cylindrical tube, having a diameter of about three inches and a vertical length of about three inches. Ring 23 has an internal diameter slightly greater than tube 13, whereby the tube can be positioned with its lower edge in relatively close proximity to the ring inner surface. The centering ring retains tube 13 in a stable centered upright position on plate 17. The tube can be lifted off the plate to gain access to the can 15 containing flammable fuel. Base 11 acts as a stable platform for can 15, such that the can is approximately level. Tube 13 acts as a protective device to shield the flame generated above can 15 from wind forces.

As shown in FIG. 1, the length of tube 13 is greater than the heighth of can 15, whereby a protected combustion zone 27 is provided above the can upper edge. The fuel in can 15 can be ignited with a match or cigarette lighter to provide a flame in combustion zone 27.

Combustion air is admitted to zone 27 through a ring of small diameter holes 29 in the wall of tube 13. Each air hole can have a diameter of about one fourth inch. The number of air holes is not critical. Eight air holes provides sufficient air for combustion. Air holes 29 are shown to be on a horizontal plane at approximately the upper mouth end of can 15. However, the air holes could be located at a lower level, e.g. near the lower edge of tube 25.

Two horizontal parallel metal bars 31 are welded or otherwise affixed to the upper edge of tube 13. Each bar preferably has a square cross section, such that the upper faces of the bars are flat and horizontal. A pan or cooking pot 33 can be placed on the bars to receive the heat generated by the ignited fuel (from can 15).

As shown in FIG. 1, bars 31 are appreciably longer than the diameter of tube 13, such that the ends of the bars overhang (or extend beyond) the tube. The bars provide a relatively stable support surface for a reasonably sized pot or pan, even though protective tube 13 has a relatively small diameter. For example, each bar 31 can have a length of about six inches, while tube 13 has a diameter of only about three inches. Base 11 extends laterally beyond tube 13 so that the cooking unit is supported in a stable position even though tube 13 has a relatively small diameter.

The small diameter of tube 13 is believed to be advantageous in that it tends to concentrate the heat in the zone directly above can 15. The heat travels essentially directly upwardly to impinge on the bottom surface of the pot or pan. Bars 31 act as spacers to space the bottom surface of pot 33 from the upper edge of tube 13. The heated gases can thus escape from tube 13 laterally along the pot bottom surface. Each bar 31 has a cross-sectional thickness of about one fourth inch, which is sufficient to form a satisfactory gas escape route for the heated gases. As the heated gases travel along the pot bottom surface they impart heat to the pot. It thus becomes possible to heat a reasonably sized pot or pan even though the can of flammable fuel may have a diameter of only about two inches.

As previously noted, tube 13 is detachable from base 11. Bars 31 are rigidly attached to the tube, such that either one of the bars can be used as a handle to place tube 13 on the base or remove the tube from the base. The tube is removed from the base during the process of lighting the fuel in can 15, or later extinguishing the flame.

As shown in FIG. 1, the upper edge of tube 13 is flared outwardly, as at 35. The flaring is believed to be advantageous in that it somewhat facilitates the outflow of hot gases as the gases turn to pass laterally outwardly along the bottom surface of the pot or pan. The edge flaring feature is an option. The cooking unit will function without the flaring upper edge of the tube.

Figure 3:
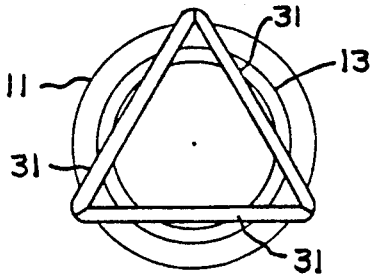
FIG. 3 is a view taken in the same direction as FIG. 2, but illustrating another embodiment of the invention.

FIG. 3 illustrates a second form of the invention that is similar to the FIG. 1 structure except for the arrangement of bars on the upper edge of tube 13. As shown in FIG. 3, there are three bars 31 arranged in the shape of a triangle. The FIG. 3 device operates in the same fashion as the FIG. 1 device.

Figure 4:
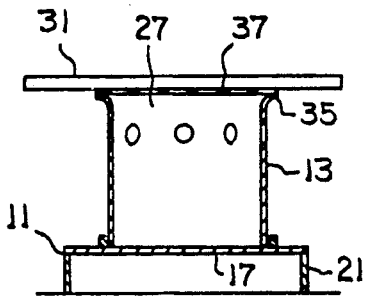
FIG. 4 is a view taken in the same direction as FIG. 1, but showing another embodiment of the invention on a reduced scale.

FIG. 4 illustrates a device that is the same as the FIG. 1 device, except that a foraminous plate 37 of expanded metal is welded to the upper edge of tube 13. Bars 31 are welded to the foraminous plate.

The primary purpose for plate 37 is ornamental; the plate gives the cooking unit a grille-like appearance. The plate also has a protective (safety) function, in that it prevents children from intentionally or inadvertently extending a finger into combustion zone 27.

It was previously noted that bars 31 can be used as handles to manipulate tube 13. However, in some cases bars 31 can be relatively hot. FIGS. 1 and 2 show a small disk-like handle 32 extending from tube 13 near its lower end. Due to its location handle 32 will not heat up to the same extent as bars 31. Disk 32 can be used as an alternative handle.

The drawings depict some representative forms that the invention can take. However, it will be appreciated that the invention can be practiced in other forms.

What is claimed is:

1. A cooking unit comprising:

a base that includes a flat plate having a peripheral edge, leg means depending from said base at its peripheral edge, and a centering ring on the upper surface of said plate;

a removable protective tube having a cylindrical cross section, said tube having a lower edge adapted to rest on said flat plate within the space circumscribed by the centering ring; said tube having a diameter that enables the tube to encircle a can of flammable fuel placed on the flat plate; said tube having an upper edge that is flared laterally outwardly from the tube cylindrical cross section; the upper and lower edges of the tube being spaced a considerable distance apart so that the length of the tube is greater than the height of the can of flammable fuel, whereby there is a protected combustion zone directly above said can; said protective tube having a ring of air holes therein for admitting combustion air to the aforementioned protected combustion zone; and at least two pot-supporting horizontal bars affixed to the upper edge of said protective tube; said bars having end portions thereof extending laterally beyond the tube, whereby a cooking pot having a diameter significantly larger than the tube diameter can be supported in a stable position on the bars; said bars constituting a spacer means for spacing the bottom surface of a supported pot a significant distance above the flared upper edge of the protective tube, whereby heated gases can escape from the tube by flowing laterally along the pot bottom surface; said flared upper edge facilitating a smooth transition of the gas from the protective tube to the gas escape space defined by the horizontal bars.

2. The cooking unit of claim 1, wherein there are two horizontal bars extending parallel to each other equidistant from the central axis of the protective tube.

3. The cooking unit of claim 2, wherein each horizontal bar has a square cross section.

4. The cooking unit of claim 1, and further comprising a foraminous plate extending horizontal across the upper edge of the protective tube below the horizontal bars.

* * * * *